US007621340B2

(12) United States Patent
Cuthill et al.

(10) Patent No.: US 7,621,340 B2
(45) Date of Patent: Nov. 24, 2009

(54) SYSTEM AND METHOD FOR CAPPING ABANDONED WELLS

(75) Inventors: Kary Cuthill, Calgary (CA); Daryl Cuthill, Fox Creek (CA)

(73) Assignee: CCS Corporation, Calgary (CA)

( * ) Notice: Subject to any disclaimer, the term of this patent is extended or adjusted under 35 U.S.C. 154(b) by 0 days.

(21) Appl. No.: 12/149,779

(22) Filed: May 8, 2008

(65) Prior Publication Data

US 2009/0211766 A1 Aug. 27, 2009

(30) Foreign Application Priority Data

Feb. 25, 2008 (CA) ..... 2,622,531

(51) Int. Cl.
*E21B 19/00* (2006.01)

(52) U.S. Cl. ..... 166/379; 166/75.13; 166/97.1; 166/92.1; 166/93.1; 166/94.1; 137/371

(58) Field of Classification Search ..... 166/75.13, 166/97.1, 379, 92.1, 93.1, 94.1; 137/371
See application file for complete search history.

(56) References Cited

U.S. PATENT DOCUMENTS 1,106,295 A * 8/1914 Gail ..... 166/76.1
1,683,173 A * 9/1928 Ervin ..... 166/87.1
3,568,769 A * 3/1971 Maass ..... 166/75.13
4,334,578 A * 6/1982 Labrum ..... 166/75.13
4,747,453 A * 5/1988 Howard, Sr. ..... 166/379
4,971,149 A * 11/1990 Roberts ..... 166/92.1
5,010,957 A * 4/1991 Kenner ..... 166/379
5,107,931 A 4/1992 Valka et al.
5,372,198 A * 12/1994 North et al. ..... 166/363
5,664,626 A 9/1997 Watts, III
6,502,632 B1 * 1/2003 Pittman ..... 166/75.13
6,845,815 B2 1/2005 Hergarden et al.
7,363,969 B2 * 4/2008 Muderlak et al. ..... 166/97.1
7,469,742 B2 * 12/2008 Larsen ..... 166/75.13
2008/0289817 A1 * 11/2008 Smith ..... 166/250.04

FOREIGN PATENT DOCUMENTS

CA 2390393 12/1945

* cited by examiner

*Primary Examiner*—Jennifer H Gay
*Assistant Examiner*—Blake Michener
(74) *Attorney, Agent, or Firm*—Davidson Berquist Jackson & Gowdey LLP

(57) ABSTRACT

The invention describes a system for capping an abandoned well having production casing and surface casing. The system enables the effective sealing of the production casing volume from the surface casing volume such that any gases leaking from either volume can be independently released from independent valves. The system is particularly effective in improving the safety of re-entering an abandoned well.

9 Claims, 4 Drawing Sheets

SYSTEM AND METHOD FOR CAPPING ABANDONED WELLS

FIELD OF THE INVENTION

The invention describes a system for capping an abandoned well having production casing and surface casing. The system enables the effective sealing of the production casing volume from the surface casing volume such that any gases leaking from either volume can be independently controlled or released from independent valves. The system is particularly effective in improving the safety of re-entering an abandoned well.

BACKGROUND OF THE INVENTION

After oil and gas wells have been abandoned after production has ceased, the wells must be properly capped to both return the land where the well is located to its previous state as well as provide a safe and stable cap to the well that minimizes risk to the land owner's subsequent use of their land as well as minimizing risk to personnel who may in the future re-enter the well. The abandoned wells are generally capped by an oil and gas company, licensee or well abandonment service provider.

Regulations in many jurisdictions generally require that in capping an abandoned well that the production and surface casings of the well be trimmed approximately 1 m below the ground surface and a simple steel plate cover system attached to the well casings. As shown in FIG. 1, simple steel covers are welded to the production casing 10 and surface casing 12 using tack welds or a continuous fillet weld 14. In each case, steel plate (typically ½") 16, 18 is usually welded to the inside of surface and production casing after the upper 1 m of each casing has been trimmed to a height approximately 1 m below the ground surface.

Unfortunately, the typical oilfield capping system has no allowance for the escape of heated gases during the capping welding process other than where the plate is being welded to the casing. In addition, there is no allowance for the escape of heated or accumulated formation gases upon re-entry of the well without hot tapping. These limitations lead to serious safety risks both during abandonment and/or re-entry.

For example, in approximately 90% of those wells that are ultimately re-entered, modest levels of formation gas will be found to be leaking at the location where the steel plates are attached to the well casing. This leaking gas which passes through the fine pores of the weld is very difficult to detect and provides limited or no information about the composition and/or backside pressure within either the production or surface casing of the well.

Moreover, the current methodologies of capping a well are problematic in a number of ways from a safety and functional perspective. Most importantly, for those wells that have been capped using a continuous fillet weld that fully seals the well, there is a risk of a significant gas pressure build-up within the well such that the procedures to re-enter the well must properly and efficiently release any pressure build-up without risk to personnel. As a result, protocols for re-entering a well are unnecessarily complex for those situations where there is limited or no safety risk but are required to ensure safety for the potentially dangerous situation. In other words, in each case, there is no provision to determine the gas composition and/or rate of leak.

In the case of cap plates that are tack-welded in place, while the unsealed weld may allow gas to dissipate, ground water may leak into the well. Groundwater is un-inhibited and rich in oxygen and micro-organisms; causing the acceleration of internal corrosion.

Moreover, the procedures to install steel cap plates are very inefficient and may not provide the effective sealing. Typically, service personnel will crudely torch cut a cap plate at the site on the back of a welding truck in an uncontrolled environment thus producing an imperfect circle that is used as the capping plate. Imperfect circles will contribute to inferior welds.

As a result, there has been a need for a system and method that addresses the above problems and more specifically provides a system that provides an effective seal to both production and surface casing, that prevents ground water contamination from entering the production and surface casing whilst allowing the release of gas from the system in a controlled manner. In addition, there has been a need for a method of abandoning a well that improves the efficiency of the at-site procedure as well as any subsequent re-entry of the well. Further still, there has been a need for a system that simplifies the re-entry protocols while enhancing the efficiency of hydrostatically killing a well if necessary.

A review of the prior art reveals that such a system has not been provided.

SUMMARY OF THE INVENTION

In accordance with the invention, there is provided a system for capping an abandoned well having production casing defining a production casing volume and surface casing defining a surface casing volume, the system comprising: a production casing plate for sealing connection to the production casing, the production casing plate having a first nipple for operative connection to a first valve; a surface casing plate for sealing connection to the surface casing, the surface casing plate having a second nipple for operative connection to a second valve; wherein the first nipple passes through and is sealed with respect to the surface casing plate such that the production casing volume is sealed from the surface casing volume.

In further embodiments, the system includes a cap for placement over and around the surface casing. The first and second valves may also enable operative connection of gas sampling equipment to the valves and/or piping to enable fluids to be pumped into the well to kill the well.

In an alternate embodiment, the invention also provides a method of sealing an abandoned well having production casing defining a production casing volume and surface casing defining a surface casing volume comprising the steps of: sealing a production casing plate to the production casing, the production casing plate having a first nipple for operative connection to a first valve; and, sealing a surface casing plate for sealing connection to the surface casing, the surface casing plate having a second nipple for operative connection to a second valve; wherein the first nipple is passed through and is sealed with respect to the surface casing plate such that the production casing volume is, sealed from the surface casing volume.

BRIEF DESCRIPTION OF THE DRAWINGS

The invention is described by the following detailed description and drawings wherein.

DETAILED DESCRIPTION OF THE PREFERRED EMBODIMENT

Figure 1:
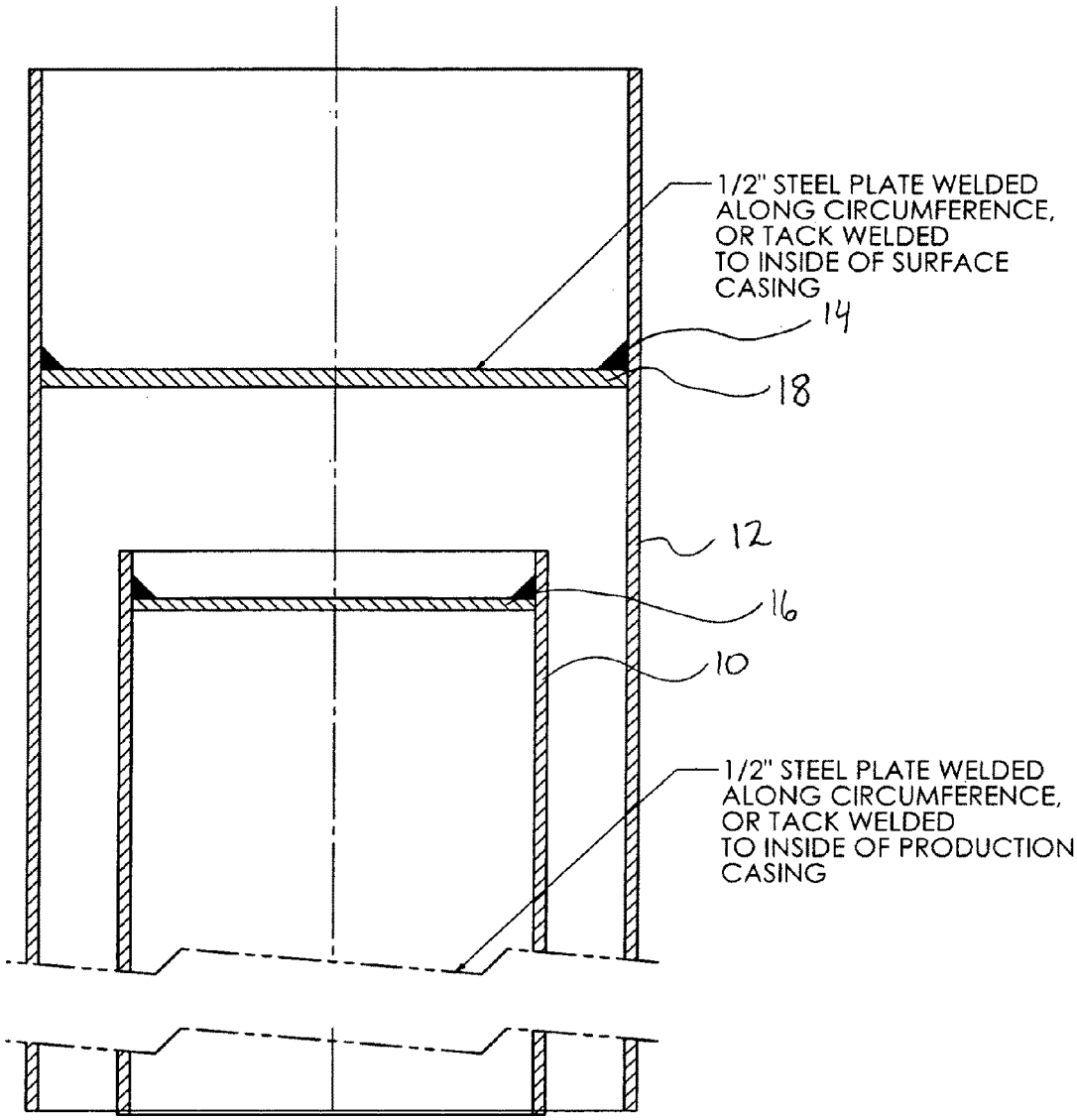
FIGURE 1 PRIOR ART
FIG. 1 is a cross sectional view of a typical capping system in accordance with the prior art.
Figure 2:
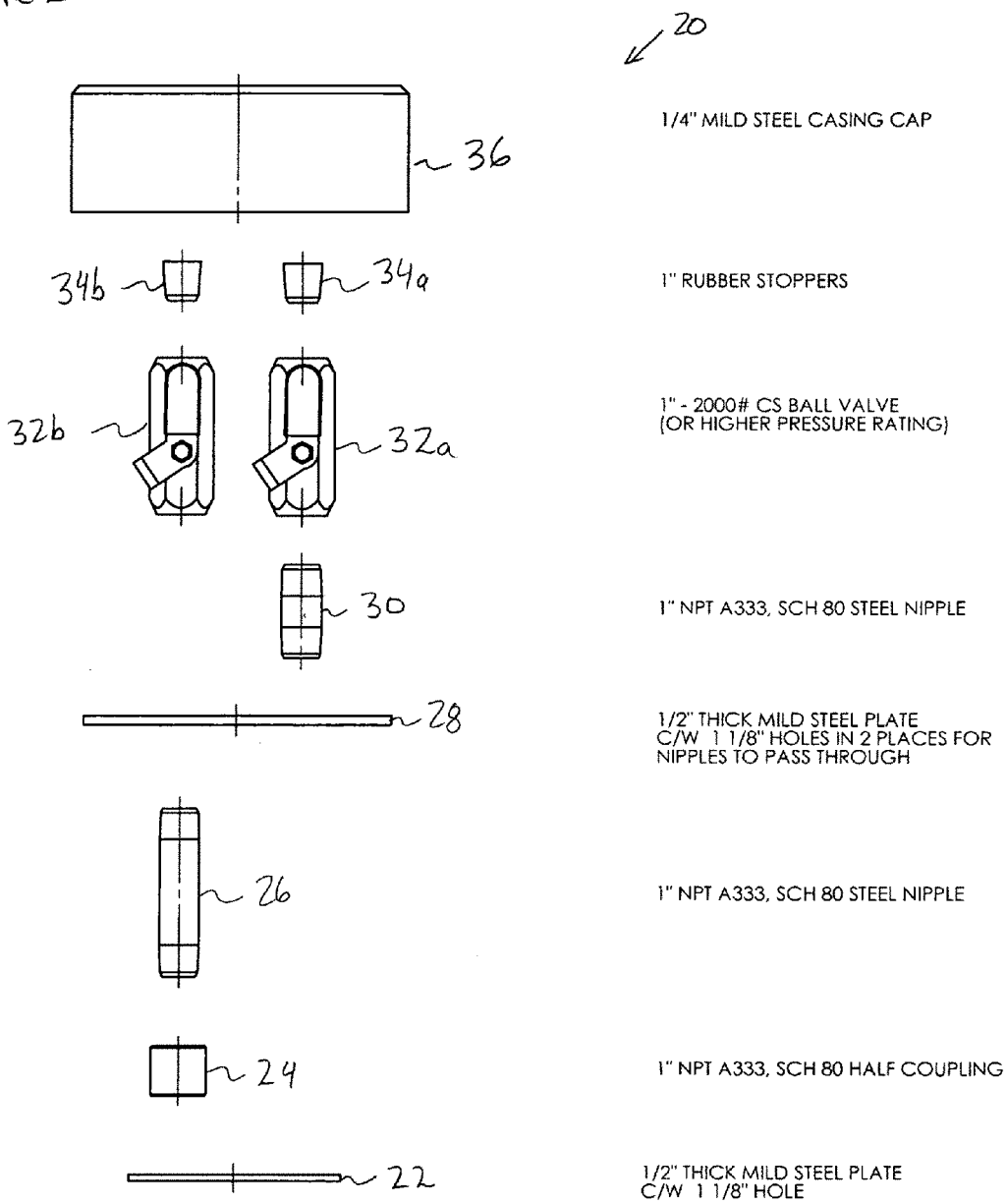
FIG. 2 is an exploded view of the well capping system in accordance with the invention.
Figure 3:
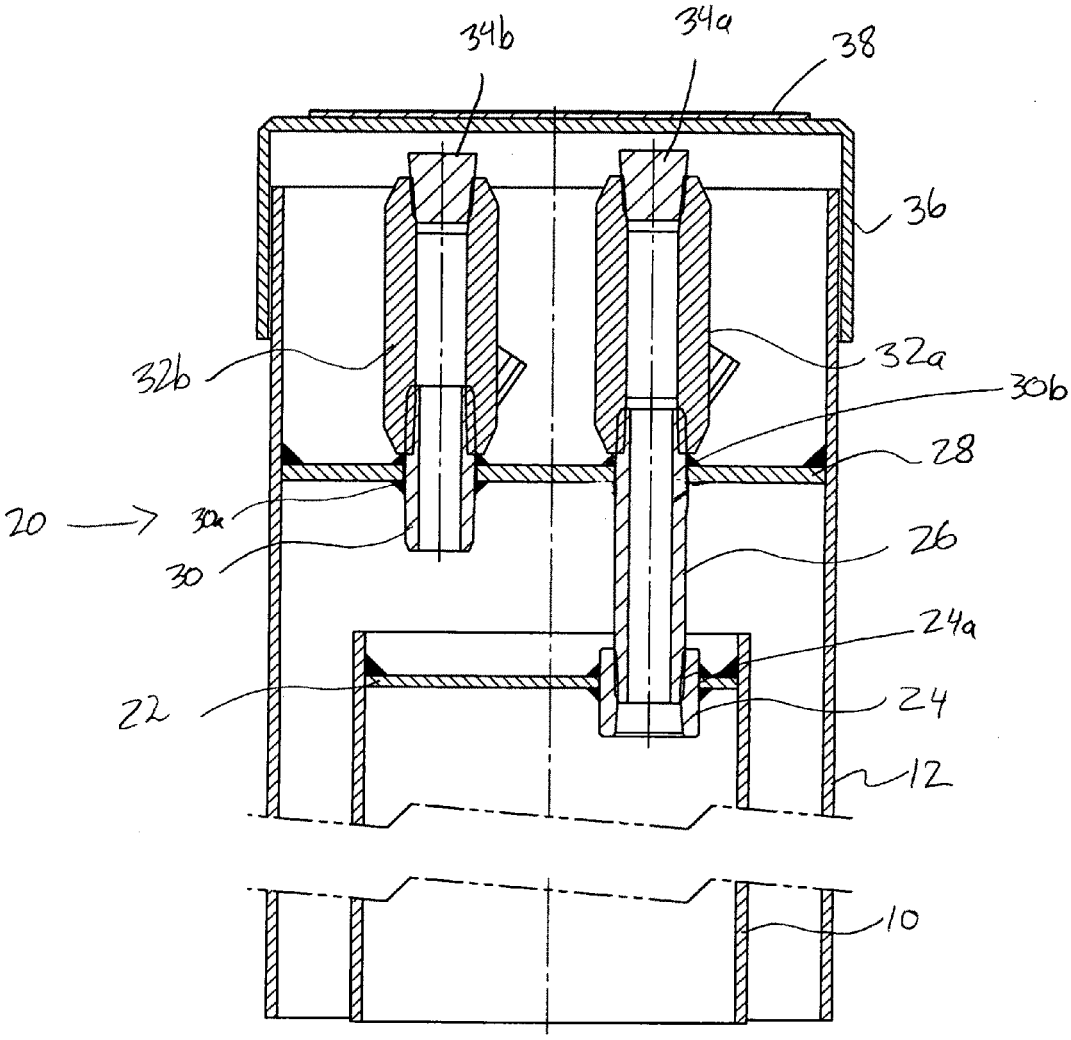
FIG. 3 is a cross-sectional view of an assembled well capping system in accordance with the invention.
Figure 4:
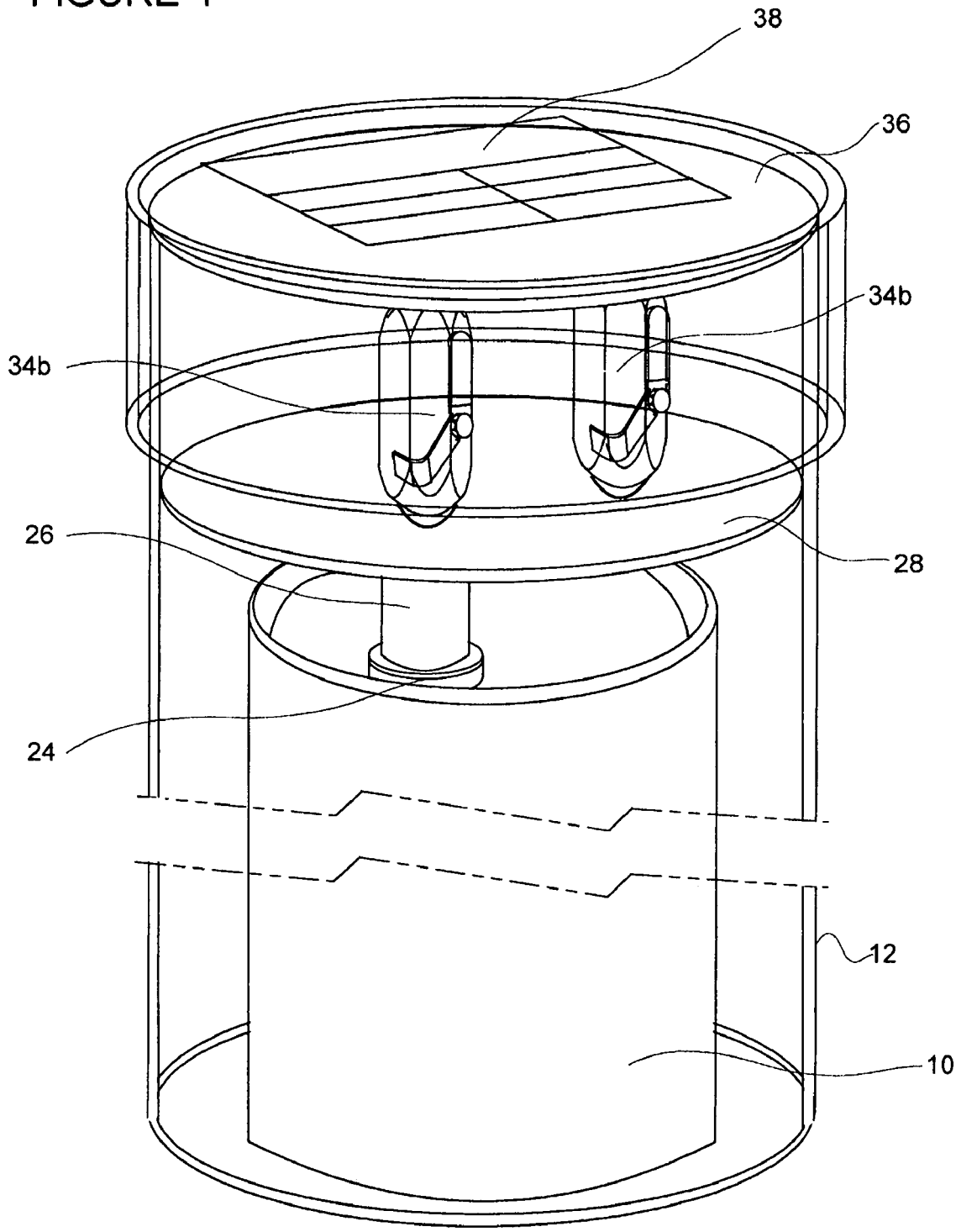
FIG. 4 is a perspective view of an assembled well capping system in accordance with the invention.

In accordance with the invention and with reference to FIGS. 2-4 a well capping system is described that provides an effective system for efficiently capping an abandoned well whilst also minimizing the risk to personnel on subsequent re-entry.

As shown in FIGS. 2 and 3, the well capping system 20 includes a production casing plate 22 having a production casing nipple 26 and coupling 24 mounted through an appropriate bore 24*a* on the production casing plate 22. The lower and upper outer edges of the production casing nipple 26 and inner surface of the coupling 24 may be provided with appropriate threads to enable threaded connection between the production casing nipple 26, the coupling 24 and a valve 32*a*. The coupling is welded to the production casing plate in such a manner that it will not effect the fillet weld around the circumference of the plate to the production casing.

The system further includes a surface casing plate 28 having a surface casing nipple 30 attached to the surface casing plate 28 through an appropriate bore 30*a* in the surface casing plate 28. Generally, the production casing plate 22 includes a threaded coupling to allow the production casing nipple 26 to be removed to allow welding around the circumference of the production casing plate and then re-installed. The surface casing plate 28 does not require as long a nipple and thus does not interfere with the weld around the circumference of the surface casing plate. The surface casing plate 28 is also provided with a second bore 30*b* to allow the production casing nipple 26 to pass through the surface casing plate. The surface casing nipple 30 is provided with appropriate threads on the upper outer surface to enable threaded connection with a valve 32*b*.

Each of valves 32*a* and 32*b* may be provided with a rubber stopper 34*a*, 34*b* that may be inserted within the valve as an indicator of gas release (as may be required by regulators). The system further includes a surface casing cap 36 dimensioned to fit over the surface casing 12. The casing cap prevents unwanted soils and rocks coming into contact or damaging the valves 32*a*, 32*b* after installation. Appropriate labeling 38 may also be provided on the casing cap 36 with information such as a unique well identifier, the licensee of the well, and the surface abandonment date as may be required or desired. In particular, this information may be particularly useful to re-entry personnel to confirm previous operation documentation and/or that the correct well has been identified, if and when an abandoned well is re-entered.

The system is configured to an abandoned well having production 10 and surface 12 casing using the following procedure:

a. The area around an abandoned well is excavated to an appropriate depth beneath the surface;
b. The surface casing is trimmed to a desired height beneath the surface;
c. The production casing is trimmed to a height approximately 8-12 inches beneath the trimmed height of the surface casing;
d. The production casing plate is tack-welded and then fully welded to the top of the production casing approximately 1 inch beneath the upper edge of the production casing. The production casing plate is preferably pre-manufactured to standard production casing dimensions with the coupling 24 pre-welded to the production casing plate.
e. The production casing nipple 26 is threaded to the coupling 24 such that it projects upwardly;
f. The surface casing plate is preferably pre-manufactured to standard surface casing dimensions together with the surface casing nipple pre-welded through the surface casing plate.
g. The bore 30*b* may or may not be pre-cut in the surface casing plate. If not, service personnel with measure and cut bore 30*b* at the site to allow production casing nipple 26 to pass through the surface casing plate.
h. Once bore 30*b* has been located and/or cut, surface casing plate is placed over the top of the production casing nipple 26 such that it protrudes above the surface casing plate by 1-4 inches.
i. The surface casing plate 28 is tack-welded and then fully welded to the surface casing. The surface casing nipple is fully welded to the surface casing plate.
j. Valves 32*a* and 32*b* are attached to the production casing and surface casing nipples 26 and 30, respectively.
k. Rubber stoppers 34*a* and 34*b* may be configured to valves 32*a* and 32*b* respectively and may be color coded in accordance with regulations to indicate venting of either production casing or surface casing gas. The surface casing plate will preferably be stamped to mark the surface casing valve and production casing valve respectively or otherwise identified as the valve communicating with either the production casing or surface casing volume.
l. Casing cap 36 is placed over the surface casing. No permanent welding is required.
m. Appropriate labeling of the cap is completed.
n. The abandoned well is back-filled and leveled.

Upon assembly, the system provides an effective system and method to both safely release leaking gas from the well and prevent ground water contamination to the well. The valves 32*a* and 32*b* may be pressure release valves (such as a ball valve), burst plates or no-release valves. In either case, personnel re-entering the well can safely release any pressure from within the well by opening both valves. Ball valves having a pressure rating of approximately 2000 psi are preferred. Pressure readings and/or gas composition can be obtained by configuring appropriate pressure reading or gas sampling equipment to the valves after removal of stoppers 34*a* or 34*b*. This is particularly important in the event that toxic $H_2S$ may be within the leaking gas.

The system also allows the ready connection of a well kill line to allow fluids to be pumped into the well in advance of re-entry. The ability to kill the well through the system while maintaining well control is the most important safety characteristic of the system that is not possible using current oilfield capping systems.

Upon determining that there are no unsafe gases in the well, the service personnel can safely removing the capping system 20 by cutting the production and surface casings below the assembly and removing the assembly and casing stubs.

Importantly, the system allows service personnel to more clearly understand if leaking gases are arising from the production casing or surface casing which may assist in determining the most-appropriate re-entry plan.

Although the present invention has been described and illustrated with respect to preferred embodiments and preferred uses thereof, it is not to be so limited since modifications and changes can be made therein which are within the full, intended scope of the invention.

The invention claimed is:

1. A system for capping an abandoned well having production casing defining a production casing volume and surface casing defining a surface casing volume, the system comprising:

a production casing plate for sealing connection to the production casing, the production casing plate having a first nipple for operative connection to a first valve;

a surface casing plate for sealing connection to the surface casing, the surface casing plate having a second nipple for operative connection to a second valve;

wherein the first nipple passes through and is sealed with respect to the surface casing plate such that the production casing volume is sealed from the surface casing volume.

2. A system as in claim 1 wherein the first valve is a pressure release valve.

3. A system as in claim 1 wherein the second valve is a pressure release valve.

4. A system as in claim 1 further comprising a cap for placement over and around the surface casing.

5. A system as in claim 1 wherein the first and second valves enable operative connection of gas sampling equipment to the valves.

6. A system as in claim 1 wherein the first and second valves enable operative connection of piping to enable fluids to be pumped into the well to kill the well.

7. A method of sealing an abandoned well having production casing defining a production casing volume and surface casing defining a surface casing volume comprising the steps of:

a. sealing a production casing plate to the production casing, the production casing plate having a first nipple for operative connection to a first valve; and b. sealing a surface casing plate for sealing connection to the surface casing, the surface casing plate having a second nipple for operative connection to a second valve, wherein the first nipple is passed through and is sealed with respect to the surface casing plate such that the production casing volume is sealed from the surface casing volume.

8. A method as in claim 7 wherein step a is preceded by trimming the production casing and surface casing such that the top of the production casing is lower than the top of the surface casing.

9. A method as in claim 7 further comprising the step of inserting stoppers into the first and second valves.

* * * * *